United States Patent [19]

Mendoza

[11] 4,369,359

[45] Jan. 18, 1983

[54] APPARATUS AND METHOD FOR CALCULATING BREAK-EVEN POINT OF ENTERPRISE

[76] Inventor: Alejandro V. Mendoza, Retorno 7 de la Avenida Ignacio Zaragoza, No. 45 Col. Jardin, Balbuena, 9, D. F., Mexico

[21] Appl. No.: 206,628

[22] Filed: Nov. 13, 1980

[51] Int. Cl.[3] ..... G06C 3/00

[52] U.S. Cl. ..... 235/89 R; 33/1 C

[58] Field of Search ..... 33/1 SB, 1 SD, 1 C; 235/88 F, 89 R

[56] References Cited

U.S. PATENT DOCUMENTS 1,074,439 9/1913 Kincaid ..... 235/89 R 2,504,532 4/1950 Kahan ..... 235/89 R 3,870,225 3/1975 Murphy ..... 235/89 R

*Primary Examiner*—William D. Martin, Jr.

*Attorney, Agent, or Firm*—Freilich, Hornbaker, Wasserman, Rosen & Fernandez

[57] ABSTRACT

The break-even point of any enterprise is quickly calculated on a Cartesian coordinate system for plotting receipts versus costs by entering in the coordinate system the fixed costs, and pivoting a cursor to extend from the origin of the coordinate on receipts at the fixed costs to the point of fixed cost plus variable costs and receipts anticipated from a selected volume of sales. The break-even point is then read from the coordinate system where the cursor intersects a line on the coordinate system having a slope of unity from the origin of receipts and costs.

5 Claims, 6 Drawing Figures

FIG. 1
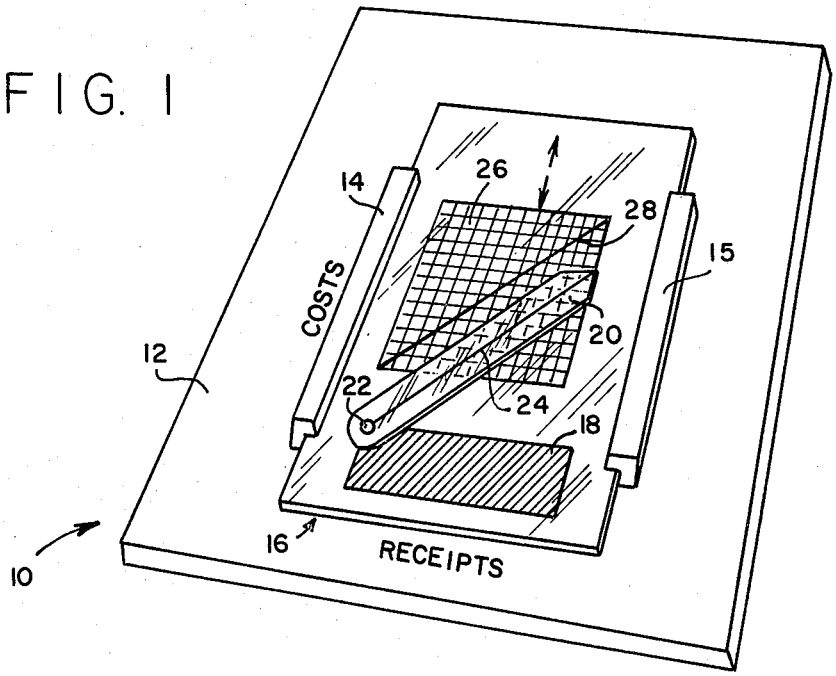
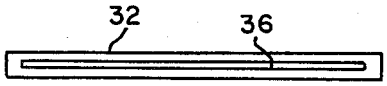
FIG. 2b
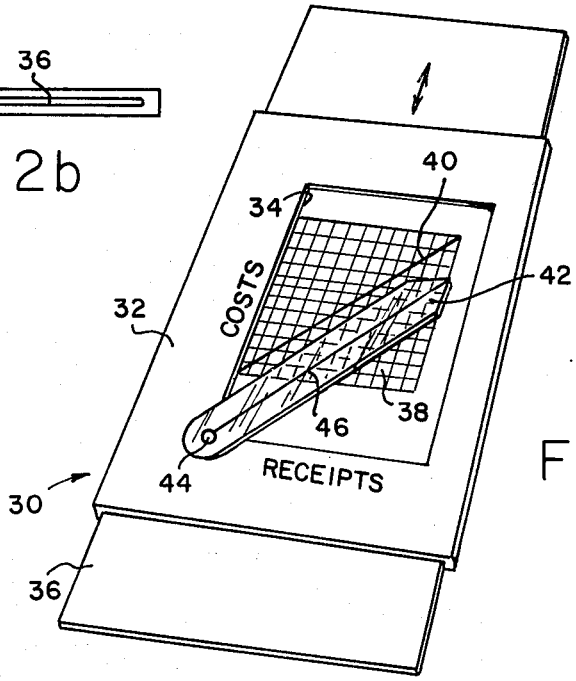
FIG. 2a

APPARATUS AND METHOD FOR CALCULATING BREAK-EVEN POINT OF ENTERPRISE

BACKGROUND OF THE INVENTION

This invention relates to a method and apparatus for quickly calculating the break-even point of any enterprise.

All enterprises, private businesses or corporations, regardless of size, need to know periodically their break-even point, i.e., the volume of business at which sums of money received from the business equal fixed and variable costs. To calculate the break-even point, a formula is traditionally employed, such as one set forth hereinafter. Such an equation may be solved in most cases in a few minutes (less than ten minutes).

It is also customary to plot the break-even point and anticipated profits for different volumes of business in order to determine the minimum volume of profitable business, and the optimum level of profitability. Since each point requires a few minutes to calculate, this can require up to 40 to 50 minutes, or more, in the usual case. It would be desirable to reduce the time to calculate each break-even point to less than a minute.

SUMMARY OF THE INVENTION

The method and apparatus for calculating a break-even point according to the invention utilizes a sheet having a rectangular two-dimensional Cartesian coordinate system inscribed for plotting costs versus receipts from net sales with provision for entering fixed costs applicable to any assumed volume of sales. A cursor is then placed from the point of fixed costs at the origin of the coordinate on receipts to the point of variable costs plus fixed costs at a selected level of receipts. The break-even point for the selected level of receipts is then read from the coordinate for receipts where the cursor intersects a line on the coordinate system having a slope of unity from the origin of both receipts and all costs. This line, which is permanently inscribed on the coordinate system, is at 45° from the origin when the linear scale of both coordinates, receipts and costs, are equal. The scale of the coordinates are to the base ten of the decimal system so that the coordinate system may be used at whatever levels of costs and sales by simply using multiples of ten in entering the coordinate system.

In one embodiment, the member on which the coordinate system is inscribed (engraved, printed or otherwise provided) is stationary, and a bar is used to enter fixed costs by moving the bar across the coordinate system to the level of fixed costs of the enterprise. In another embodiment, the member on which the coordinate system is provided is moved instead. In either case, the difference between the cursor and the line having a slope of unity on the coordinate system is a measure of profits for sales above the break-even point, and of losses for sales below the break-even point. Each of the break-even points and profits at various volumes of sales may be calculated in less than a minute with this apparatus to quickly plot graphs of profits as a function of sales for given fixed costs. Such graphs can assist management in planning of production for sales.

The novel features that are considered characteristic of this invention are set forth with particularity in the appended claims. The invention will best be understood from the following description when read in connection with the accompanying drawings.

BRIEF DESCRIPTION OF THE DRAWINGS

FIG. 1 is a perspective view of a first embodiment of the invention.

FIG. 2*a* is a perspective view of a second embodiment of the invention, and FIG. 2*b* is an end view of this second embodiment.

Figure 3A:
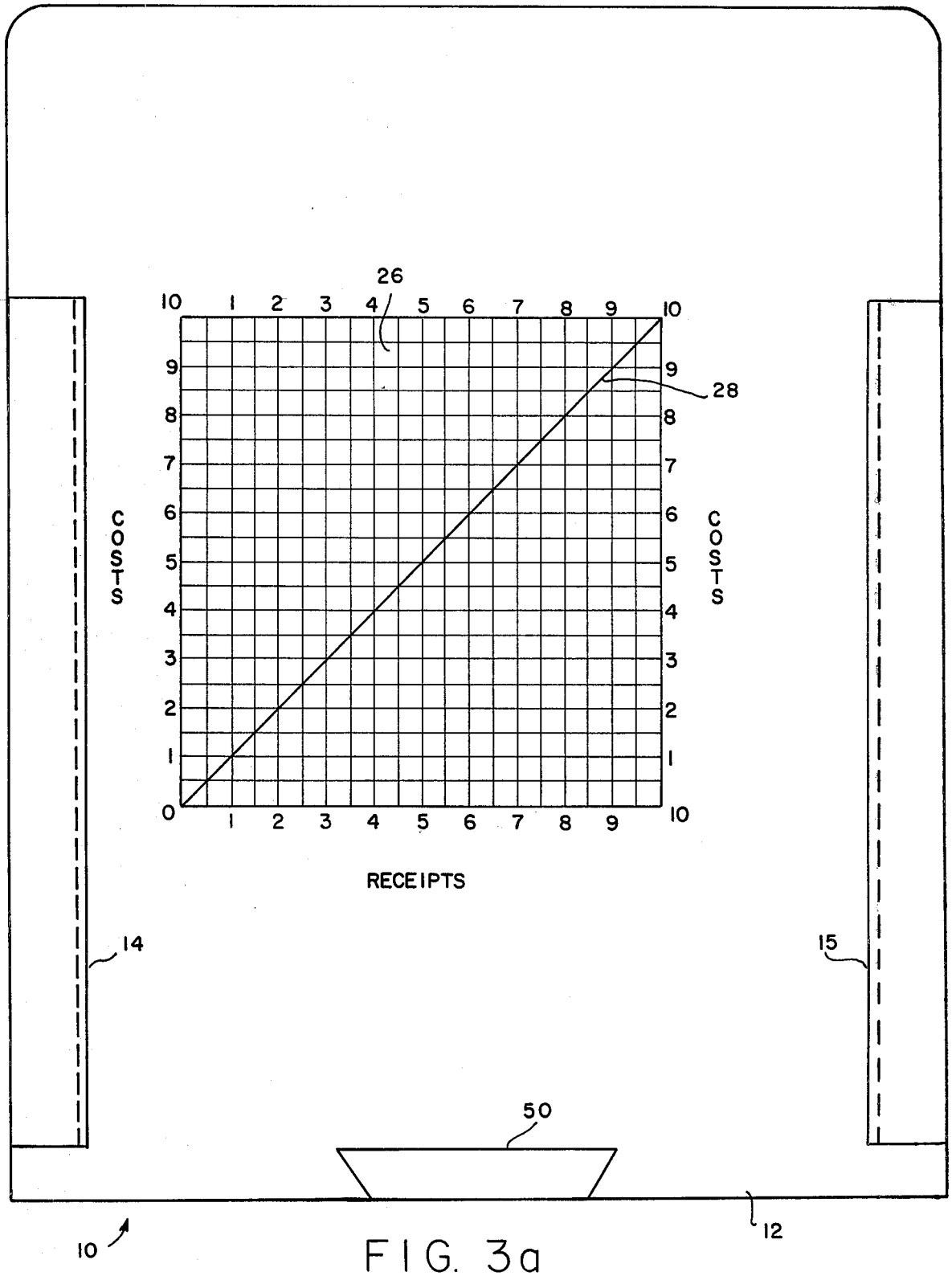
FIG. 3*a* is a plan view of a first, base member of a preferred implementation of the first embodiment.

These embodiments of the invention, and the preferred implementation of the first embodiment, will now be described with reference to the drawings and a specific example.

DESCRIPTION OF PREFERRED EMBODIMENTS

Referring now to FIG. 1, a first, base member 10 of one embodiment of the invention is comprised of a rigid sheet or plate 12, such as a sheet of metal or a plate of plastic and two guides, 14 and 15, for a second, slidable member 16. The first member will be referred to hereinafter as the "base" and the second member 16, will be referred to hereinafter as the "slide." The slide is made of transparent material, such as a sheet of glass or plexiglass, and has inscribed on it a bar 18 parallel to a horizontal coordinate for receipts. The bar is preferably inscribed as a rectangular area of fine lines in close proximity to each other at some convenient angle to the base, but may be a single horizontal line corresponding to the upper edge of the hatched area shown. Consequently, the term bar hereinafter refers to that upper edge of the hatched area or simply a single line.

Carried the slide is an arm 20 pivoted on a pin 22 at the left of the bar 18. The arm is also made of transparent material, preferably of the same material as the slide. A thin line 24 is inscribed on the under side of the arm from the tip thereof to the pin. This line, hereinafter referred to as the cursor, intersects the axis of the pin 22, which is at the origin of the bar 18.

Inscribed on the base is a Cartesian coordinate system 26 for plotting receipts versus costs, where receipts are as defined by the enterprise, such as gross revenues from sales less shipping costs and commissions, and where costs are made up of fixed costs and variable costs. Generally speaking, fixed costs are the aggregate of expenses that are a function of time and which have nothing to do with the volume of production or sales, such as rent. These fixed costs are commonly referred to as "overhead." Variable costs then are the aggregate of expenses that are a function of the volume of business and which vary proportionally with volume over at least a range of interest.

The Cartesian coordinates are drawn to a base of the decimal system, i.e., with ten units for the full scale and ten divisions within each unit so that the coordinate system may be used in any enterprise at whatever volume of business by simply using multiples of ten. Also inscribed on the coordinate system is a diagonal line 28 from the origin of the coordinate system with a slope of unity, which is 45° from the base when the linear scales for both coordinates are of equal length.

The manner in which this coordinate system 26 is used with the bar 18, cursor 24 and line 28 will be described in detail after first describing the underlying mathematical basis for calculations of the break-even point of an enterprise. Traditionally, the break-even point (BEP) of an enterprise can be calculated by solving a formula which includes costs and sales. The inventor has devised such a formula, which may be reduced to the following simple form:

$$BEP = \frac{FCs}{1 - \frac{VCs}{TSn}}$$

where

FCs=fixed costs,

VCs=variable costs, and

TSn=total sales, net.

To calculate the BEP for a given set of conditions, this formula is solved in most cases in a few minutes (10 or less). But to view the break-even point objectively, it is desirable to calculate it for a variety of different conditions and to plot the results in order to determine the optimum set of conditions for a maximum profit over a projected period. This may take 40 to 50 minutes for as few sets of conditions as a half dozen. As new experience or changes occur on a day to day basis, such as a change in the cost of materials, the cost of labor, property taxes or rent, it is necessary to calculate another set of BEPs in order to determine whether or not an adjustment should be made in the volume of business over the projected period. This invention reduces the task of calculating BEPs and generating a graph of BEPs and profits to less than a minute for each set of conditions. It is thus possible to make hundreds of calculations in a very short time, possibly at the rate of two per minute, even without any knowledge of the foregoing formula or the underlying theory of the formula. Before describing in detail how this is done, a second embodiment of the invention will be described with reference to FIGS. 2*a* and 2*b*.

Referring first to FIG. 2*a*, a first member 30 is provided in the form of a sheet 32, such as cardboard sheet folded over with a window 34 on one side through which a second member 36 may be viewed. The first member 30, referred to hereinafter as the slide completely surrounds the second member 36 as shown in FIG. 2*b*. This second member, referred to hereinafter as the base may also be made of cardboard. Printed on the base is a Cartesian coordinate system 38 for plotting receipts versus costs, and a diagonal line 40, the same as described above for the first embodiment. The bottom edge of the window 34 now serves the same purpose as the bar 18 in the embodiments of FIG. 1, and may therefore be referred to as the "bar." A transparent arm 42 is pivoted on a pin 44 having its axis at the origin of the coordinates for receipts and costs. A line 46 is inscribed on the underside of the arm and used as a cursor.

Briefly, either embodiment is used to calculate a break-even point from a set of fixed costs, variable costs and a selected volume of receipts, by moving the slide upwardly on the coordinate system until the pivot axis of the cursor is at the fixed cost level. Then the cursor is pivoted until it crosses the point of the variable costs plus fixed costs and the selected receipts. Since the bar is at the level of fixed costs, the variable costs are easily entered by counting up from the bar units on the coordinate of costs. The intersection of the cursor with the diagonal line (28 in FIG. 1 and 40 in FIG. 2*b*) establishes the BEP for all levels of receipts. The difference between the cursor and the diagonal line is a measure of profits to be expected at all levels of receipts above the BEP, and a measure of losses at all levels of receipts below the BEP. A specific example which will clarify this will now be presented with reference to a preferred implementation of the invention according to the embodiment of FIG. 1 shown in FIGS. 3*a*, 3*b* and 3*c*.

Figure 3B:
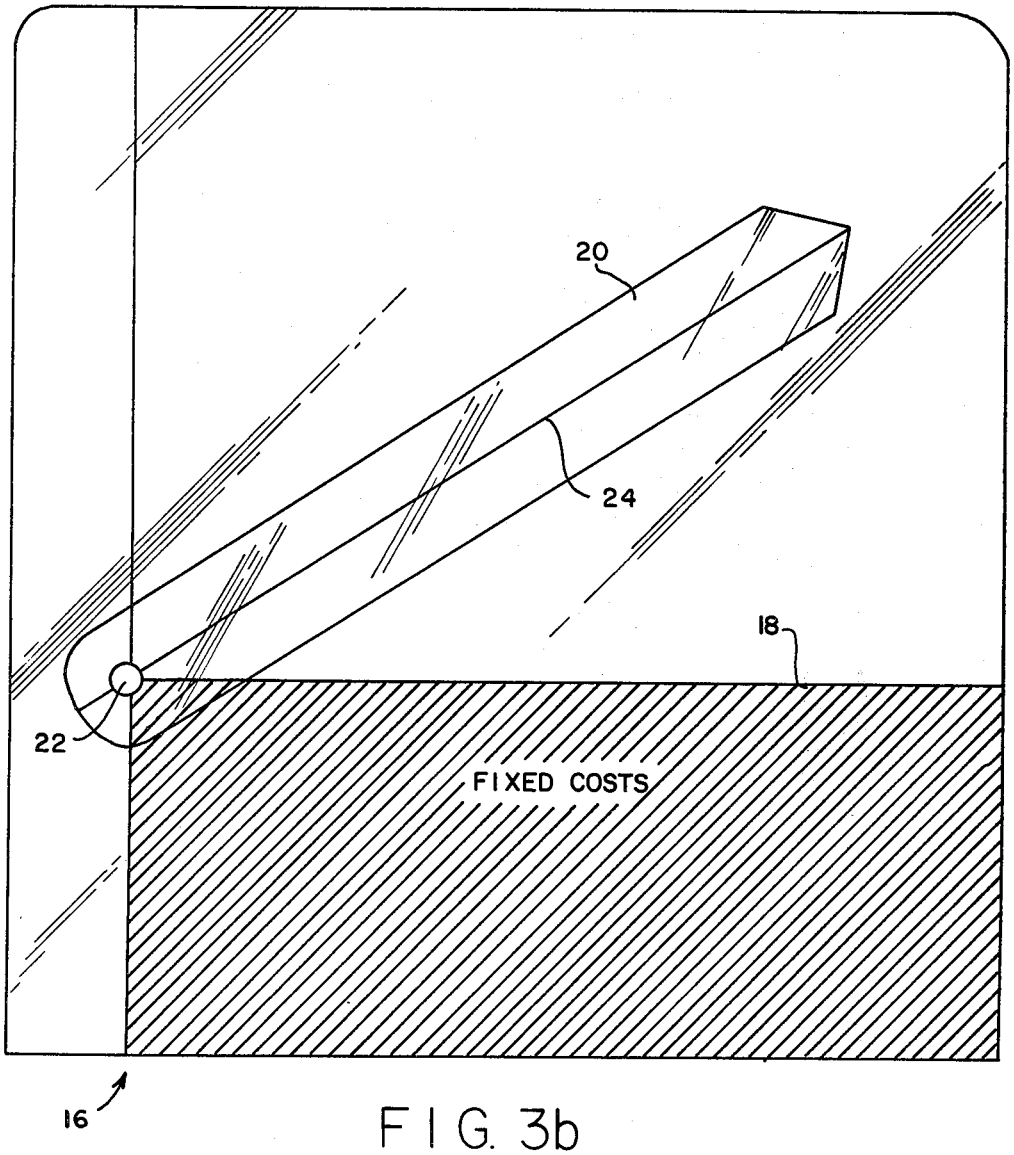
FIG. 3*b* is a plan view of a second, slidable member of the preferred implementation.
Figure 3C:
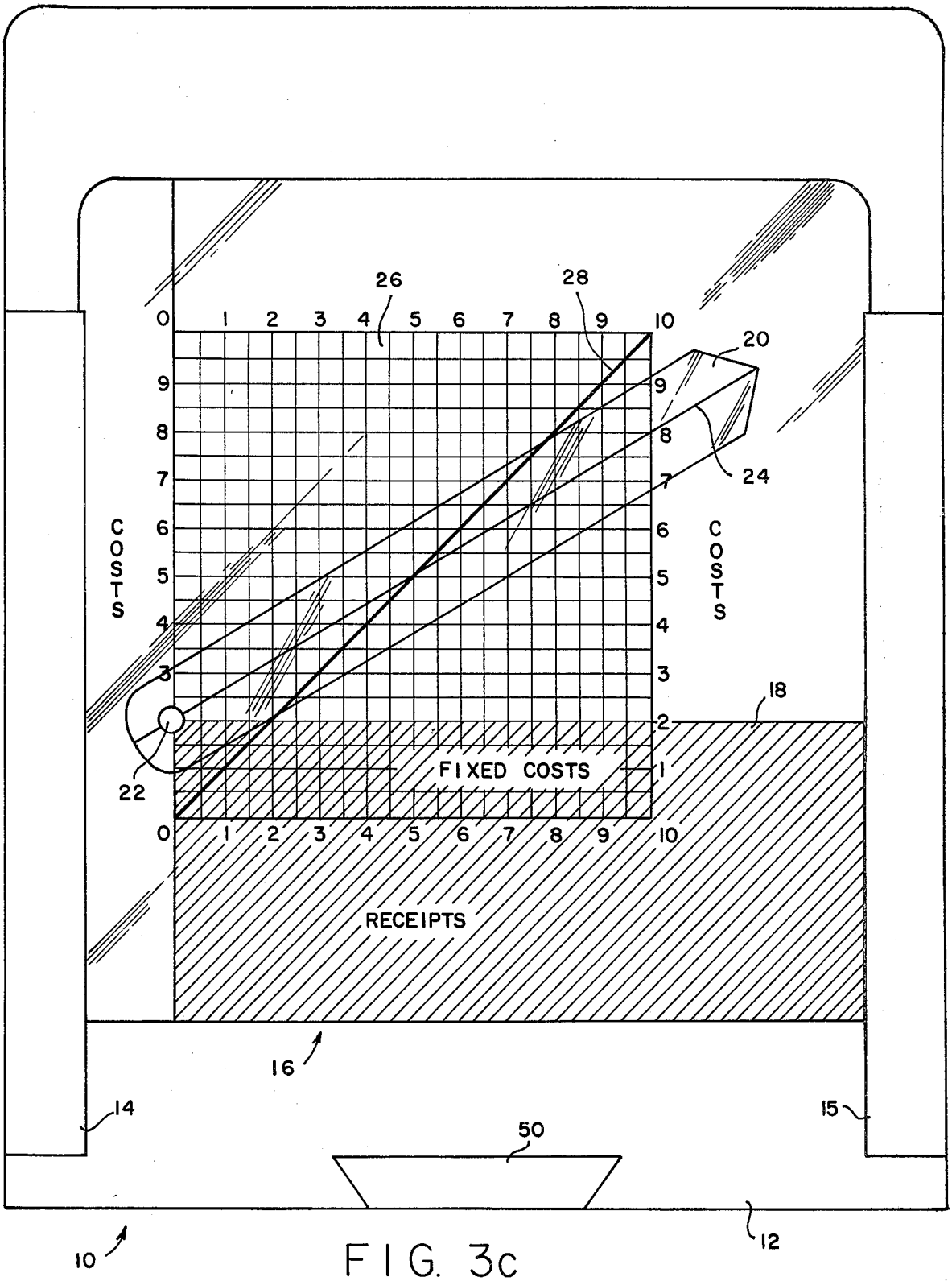
FIG. 3*c* is a plan view of the assembled first and second members of this preferred implementation.

In FIG. 3*a*, all of the components referred to in FIG. 1 are identified by the same reference numerals of FIG. 1 so that the description given with respect to FIG. 1 will apply directly. All that has been added is a stop 50 so that the slide will not slip down off of the base. FIG. 3*b* shows the slide, where again all of the same reference numerals of FIG. 1 are used. FIG. 3*c* then shows the slide of FIG. 3*b* in the guides of the base (FIG. 3*a*). The slide is shown in a position that illustrates a specific example which assumes the fixed costs to be 2 units (hundreds, thousands, tens of thousands, or whatever), and the variable costs 4.5 units for a volume of sales equal to 7.5 units, where the units are the same as selected for the fixed costs. To enter the variable costs, the cursor is pivoted until it crosses the point of 7.5 units of sales and 4.5 units of costs above the fixed costs, i.e., the point of 7.5 receipts and 2+4.5=6.5 costs. The BEP is then read as 5 units of sales directly below the intersection of the cursor and the diagonal line 28.

Note that the diagonal line has a slope of unity such that, for all points along it, costs equal receipts, so there is neither a profit nor a loss for any volume of receipts above the fixed costs. The example illustrated in FIG. 3*c* demonstrates that there is a loss below 5 units of receipts, and the loss increases as receipts decline, until receipts equal the fixed costs, at which point the loss is the sum of fixed costs and variable costs for that low rate of production and sales. What is more interesting is the graph to the right of the BEP. This apparatus quickly shows the increase in profits as production and sales are increased, even beyond the selected level of 7.5, assuming the variable costs continue at the same rate. One can thus quickly project profits through increases in sales. And by plotting the profits for many different BEPs, it is possible to select the optimum level of business, particularly when some of the different levels entail different fixed costs as well as variable costs.

Although particular embodiments of the invention have been described and illustrated herein, it is recognized that modifications and variations may readily occur to those skilled in the art. For example, a sheet of paper with a printed coordinate system and diagonal line could be used with a ruler to draw a line from the point of zero receipts and fixed costs to the point of fixed costs plus variable costs and selected receipts. Instead of drawing the line, a transparent ruler with a longitudinal line inscribed may be properly positioned while the BEP and profits are read. Consequently, it is intended that the claims be interpreted to cover such modifications and equivalents.

What is claimed is:

1. A method for graphically calculating a break-even point of an enterprise for anticipated receipts from a selected volume of business with applicable fixed and variable costs making up total costs, where fixed costs are the aggregate of expenses which are a function of time and have nothing to do with the volume of business, and variable costs are the aggregate of expenses that are a function of the volume of business and which vary proportionally with volume, comprising the steps of, preparing a Cartesian coordinate system for plotting receipts versus costs with a diagonal line of unity slope extending from the origin of costs and receipts, placing a line to extend from a point of fixed costs and zero receipts through the point of total costs and anticipated receipts for a selected volume of business, and reading the break-even point at the level of receipts where said line thus placed intersects said diagonal line.

2. A method as defined in claim 1 including the steps of determining anticipated profits from receipts above the break-even point from the difference in costs between the line thus placed and said diagonal line, and determining anticipated losses from receipts below the break-even point from the difference in costs between said diagonal and the line thus placed.

3. Apparatus for graphically calculating the break-even point of an enterprise for anticipated receipts from a selected volume of business with applicable fixed and variable costs making up total costs, where fixed costs are the aggregate of expenses which are a function of time and have nothing to do with the volume of business, and variable costs are the aggregate of expenses that are a function of the volume of business and which vary proportionally with volume of business comprising:

a sheet having inscribed a Cartesian coordinate system for plotting receipts versus costs, and further having inscribed a diagonal line plotted for receipts versus total costs of unity slope, means for indicating a level of fixed costs on said coordinate system, and means for placing a line from the point of fixed costs and zero receipts to a point on said coordinate system of total costs and anticipated receipts for a selected volume of business, whereby the break-even point is determined to be at the level of receipts where said line thus placed intersects said diagonal line.

4. Apparatus as defined in claim 3 wherein said sheet having a Cartesian coordinate and diagonal line inscribed thereon is comprised of a base plate with two parallel guides with said Cartesian coordinate system and diagonal line inscribed between said two guides with the coordinate of costs parallel to said guides, and said means for indicating a level of fixed costs is comprised of a sheet of transparent material positioned to slide between said two guides, said transparent sheet having inscribed thereon a bar parallel with the coordinate of receipts and said means for placing a line from the point of fixed costs and zero receipts to the point of total costs and zero receipts is comprised of an arm having a cursor inscribed along its length, said arm being pivoted at a point on said transparent sheet at the origin of said bar, whereby receipts equal zero for whatever level of fixed costs are selected for the problem of calculating a break-even point.

5. Apparatus as defined in claim 3 wherein said sheet having a Cartesian coordinate and diagonal line inscribed thereon is comprised of a plate and said means indicating a level of fixed costs on said graph is comprised of an opaque sheet having a window, said plate being slidable relative to the bottom of said window in said sheet for indicating a level of fixed costs, and said Cartesian coordinate system and diagonal line are inscribed on said slidable plate between the sides of said window, and said means for placing a line from the point of fixed costs and zero receipts to the point of total costs and anticipated receipts is comprised of an arm having a cursor inscribed along its length, said arm being pivoted on said opaque sheet at a corner of said window corresponding to the origin of receipts.

* * * * *